US007658170B2

(12) United States Patent
Wada et al.

(10) Patent No.: US 7,658,170 B2
(45) Date of Patent: Feb. 9, 2010

(54) TWO-CYCLE ENGINE

(75) Inventors: Shinichi Wada, Kawagoe (JP); Buhei Kobayashi, Kawagoe (JP)

(73) Assignee: Husqvarna Zenoah Co., Ltd., Kawagoe-Shi (JP)

( * ) Notice: Subject to any disclaimer, the term of this patent is extended or adjusted under 35 U.S.C. 154(b) by 0 days.

(21) Appl. No.: 12/224,641

(22) PCT Filed: Mar. 2, 2007

(86) PCT No.: PCT/JP2007/054056

§ 371 (c)(1),
(2), (4) Date: Sep. 2, 2008

(87) PCT Pub. No.: WO2007/102428

PCT Pub. Date: Sep. 13, 2007

(65) Prior Publication Data

US 2009/0007894 A1 Jan. 8, 2009

(30) Foreign Application Priority Data

Mar. 3, 2006 (JP) ..... 2006-058557

(51) Int. Cl.
*F02B 33/00* (2006.01)

(52) U.S. Cl. ..... 123/73 V; 123/51 B

(58) Field of Classification Search ..... 123/51 B, 123/73 PP, 73 A, 73 AA, 73 V, 41.4, 59.7, 123/59.1, 65 V; 261/45, 44.8, 41.5
See application file for complete search history.

(56) References Cited

U.S. PATENT DOCUMENTS 1,737,496 A * 11/1929 Feroldi ..... 261/44.8
3,410,539 A * 11/1968 Walker ..... 261/41.5
4,271,096 A * 6/1981 Kobayashi ..... 261/44.8
4,356,801 A * 11/1982 Graham ..... 123/337

(Continued)

FOREIGN PATENT DOCUMENTS

JP 10-252565 9/1998

(Continued)

OTHER PUBLICATIONS

International Search Report dated May 1, 2007, issued in PCT/JP2007/054056.

(Continued)

*Primary Examiner*—Michael Cuff
*Assistant Examiner*—Hung Q Nguyen
(74) *Attorney, Agent, or Firm*—Frishauf, Holtz, Goodman & Chick, P.C.

(57) ABSTRACT

A stratified scavenging two-cycle engine includes: an air passage for delivering pure air to a scavenging passage; an air valve for opening and closing the air passage; and an auxiliary air passage for delivering the pure air to the scavenging passage when the air valve is completely closed. An amount of air for air-fuel mixture sucked in a crank chamber is reduced to increase the concentration of the air-fuel mixture, and air that supplements the reduced amount of the air for air-fuel mixture is fed into the scavenging passage through the auxiliary air passage, which enables the engine to be smoothly accelerated even when being suddenly accelerated from an idling state with an appropriate concentration of the air-fuel mixture sucked in a cylinder chamber during idling.

2 Claims, 20 Drawing Sheets

U.S. PATENT DOCUMENTS

| | | | | |
|---|---|---|---|---|
| 4,768,494 | A * | 9/1988 | Hale | 123/579 |
| 4,909,211 | A * | 3/1990 | Cook et al. | 123/337 |
| 5,749,335 | A * | 5/1998 | Flanery, Jr. et al. | 123/337 |
| 6,454,242 | B1 * | 9/2002 | Garrick et al. | 251/208 |
| 6,561,160 | B2 * | 5/2003 | Suzuki et al. | 123/337 |
| 2001/0013327 | A1 * | 8/2001 | Ryu et al. | 123/196 R |
| 2001/0020454 | A1 | 9/2001 | Kobayashi | |
| 2004/0055546 | A1 * | 3/2004 | Nonaka | 123/73 A |
| 2004/0251564 | A1 * | 12/2004 | Mavinahally | 261/23.3 |
| 2005/0139179 | A1 | 6/2005 | Mavinhally et al. | |
| 2006/0005795 | A1 * | 1/2006 | Yuasa et al. | 123/73 PP |

FOREIGN PATENT DOCUMENTS

| | | |
|---|---|---|
| JP | 2001-254623 | 9/2001 |

OTHER PUBLICATIONS

Notification Concerning Transmittal of International Preliminary Report on Patentability, Chapter I of the Patent Cooperation Treaty and PCT Written Opinion of the International Searching Authority for PCT/JP2007/054056, 4 sheets.

* cited by examiner

TWO-CYCLE ENGINE

This application is a U.S. National Phase Application under 35 USC 371 of International Application PCT/JP2007/054056 filed Mar. 2, 2007.

TECHNICAL FIELD

The present invention relates to a stratified scavenging two-cycle engine.

BACKGROUND ART

Conventionally, a stratified scavenging two-cycle engine including an air passage that communicates with a scavenging passage has been known (for example, see Patent Document 1). The stratified scavenging two-cycle engine is capable of supplying pure air to an upper portion of the scavenging passage through the air passage, the pure air firstly scavenging combustion gas. As compared with a conventional two-cycle engine in which air-fuel mixture scavenges the combustion gas, the above-described stratified scavenging two-cycle engine is capable of reducing an amount of unburned air-fuel mixture exhausted during scavenging, improving fuel consumption, and cleaning up exhaust gas.

Operation of such a conventional stratified scavenging two-cycle engine during idling will be briefly described below.

FIGS. 20A and 20B are schematic diagrams respectively illustrating an intake process and a scavenging process of the conventional stratified scavenging two-cycle engine during idling.

In the conventional stratified scavenging two-cycle engine during idling, a piston 23 is moved from a bottom dead center to a top dead center, whereby a mixture passage 800 is opened in a crank chamber 25 and a sufficient amount of the air-fuel mixture for idling is delivered into the crank chamber 25 from the mixture passage 800 in the intake process as shown in FIG. 20A. An air valve (not shown) provided in an air passage 700 is generally closed during idling so that the pure air is not delivered from the air passage 700.

When the piston 23 ascends to reach around the top dead center, the air-fuel mixture is ignited to be combusted, i.e. bursted. Due to the burst, the piston 23 starts to descend. When the piston 23 further descends, an exhaust passage (not shown) and a scavenging passage 9 are sequentially opened and the exhaust gas is exhausted from the exhaust passage in the scavenging process as shown in FIG. 20B. At the same time, a part of the air-fuel mixture in the crank chamber 25 is delivered into a cylinder chamber 24 through the scavenging passage 9. Subsequently, the piston 23 starts to ascend from the bottom dead center to repeat the above-described series of procedures.

[Patent Document] JP-A-10-252565

DISCLOSURE OF THE INVENTION

Problems to be Solved by the Invention

FIGS. 21A and 21B are schematic diagrams respectively illustrating an intake process and a scavenging process of the conventional stratified scavenging two-cycle engine while being suddenly accelerated from an idling state.

In the conventional stratified scavenging two-cycle engine while being suddenly accelerated from its idling state, the air-fuel mixture is fed into the crank chamber 25 from the mixture passage 800 and the pure air is fed into the scavenging passage 9 from the air passage 700 through a groove 230 penetrating the piston 23 in the intake process as shown in FIG. 21A. However, since a great amount of the air-fuel mixture having an appropriate concentration for idling resides in the crank chamber 25 at this time, the residual air-fuel mixture having the appropriate concentration for idling is fed into the cylinder chamber 24 in the scavenging process as shown in FIG. 21B. The air-fuel mixture fed into the cylinder chamber 24 is mixed with a part of the pure air residing in the cylinder chamber 24 to be diluted. Accordingly, the conventional stratified scavenging two-cycle engine is not capable of supplying the air-fuel mixture having a sufficient concentration for acceleration, which leads to acceleration failure or engine stop. An acceleration pump may be provided for temporarily increasing an amount of the fuel during the acceleration in order to solve the above-described problems, however, a complicated structure and considerable cost are required therefor.

An object of the present invention is to provide a two-cycle engine with a simple structure capable of exhibiting sufficient acceleration.

Means for Solving the Problems

A stratified scavenging two-cycle engine according to an aspect of the invention includes an air passage for delivering pure air to a scavenging passage, an air valve for opening and closing the air passage, and an auxiliary air passage for delivering the pure air to the scavenging passage while the air valve is completely closed or minimally opened for idling.

According to the aspect of the invention, the stratified scavenging two-cycle engine includes the auxiliary air passage for delivering the pure air to the scavenging passage while the air valve is completely closed or minimally opened. During idling, the amount of air is reduced by adjusting a mixture valve to concentrate air-fuel mixture and the densely concentrated air-fuel mixture is fed into the crank chamber through a mixture passage. At the same time, air that supplements the reduced amount of the air is fed into the scavenging passage through the auxiliary air passage. Then, in a scavenging process, the concentrated air-fuel mixture is fed into the cylinder chamber to be mixed with a part of the pure air residing in the cylinder chamber, so that the concentration of the air-fuel mixture in the cylinder chamber becomes substantially equal to that in the conventional stratified scavenging two cycle engine during idling.

In sudden acceleration from an idling state, the air-fuel mixture is fed into the crank chamber while a great amount of the densely concentrated air-fuel mixture sucked during idling resides in the crank chamber. Since the air-fuel mixture containing the concentrated air-fuel mixture is fed into the cylinder chamber, the air-fuel mixture have a sufficient concentration in the cylinder chamber for acceleration even after the air-fuel mixture is mixed with the part of the pure air to be diluted in the cylinder chamber, which enables the engine to be smoothly accelerated.

All of the air has been conventionally used as the air-fuel mixture during idling. However, according to the aspect of the invention, the amount of air for the air-fuel mixture is reduced and air that supplements the reduced amount of the air is fed into the scavenging passage through the auxiliary air passage. Thus, the engine can be smoothly accelerated when being suddenly accelerated from the idling state while an air amount and a fuel amount sucked in the engine are equal to those in the conventional engine. In addition, a structure of the engine can be simplified since an acceleration pump and the like are not necessary, and a constant pure air can be supplied to the engine from the auxiliary air passage.

The air valve may be a rotary valve and the auxiliary air passage may include a groove-shaped portion provided on an outer circumference of the air valve.

In this arrangement, the auxiliary air passage is defined by the groove-shaped portion provided on the outer circumference of the air valve, so that the constant pure air is supplied to the engine of the simple structure during idling.

The air valve may be a rotary valve and the auxiliary air passage may include a hole provided on the air valve.

In this arrangement, the auxiliary air passage is defined by the hole provided on the air valve, so that the constant pure air is supplied to the engine of the simple structure during idling.

The air valve may be a butterfly valve and the auxiliary air passage may include a. groove-shaped portion provided on an inner circumference of the air passage in a carburetor.

The air valve may be a butterfly valve and the auxiliary air passage may include a hole provided on the air valve.

The air valve may be a butterfly valve and the auxiliary air passage may include a notch provided on the air valve.

In this arrangement, the auxiliary air passage is defined by the groove-shaped portion provided on the inner circumference of the air passage in the carburetor, the hole provided on the air valve, or the notch provided on the air valve. Thus, even when the air valve is the butterfly valve, the constant pure air is supplied to the engine of a simple structure during idling.

The auxiliary air passage may intercommunicate between an air-cleaner element downstream side and an insulator.

In this arrangement, since the auxiliary air passage intercommunicates between the air cleaner downstream side and the insulator, the engine is made capable of delivering the pure air into the scavenging passage through the auxiliary air passage. Therefore, the amount of air for the air-fuel mixture is reduced and air that supplements the reduced amount of the air is delivered into the scavenging passage through the auxiliary air passage. Thus, the engine can be smoothly accelerated when being suddenly accelerated from the idling state while the air amount and the fuel amount sucked in the engine are equal to those in the conventional engine.

The auxiliary air passage may include a pipe attached over an air cleaner and a cylinder to intercommunicate between an air-cleaner element downstream side and the air passage in the cylinder.

In this arrangement, the auxiliary air passage that intercommunicates between the air-cleaner element downstream side and the air passage in the cylinder includes the pipe attached over the air cleaner and the cylinder. Thus, a structure of the engine can be simplified and manufacturing thereof can be facilitated.

BEST MODE FOR CARRYING OUT THE INVENTION

First Exemplary Embodiment

A first exemplary embodiment of the invention will be described below with reference to the drawings.

Figure 1:
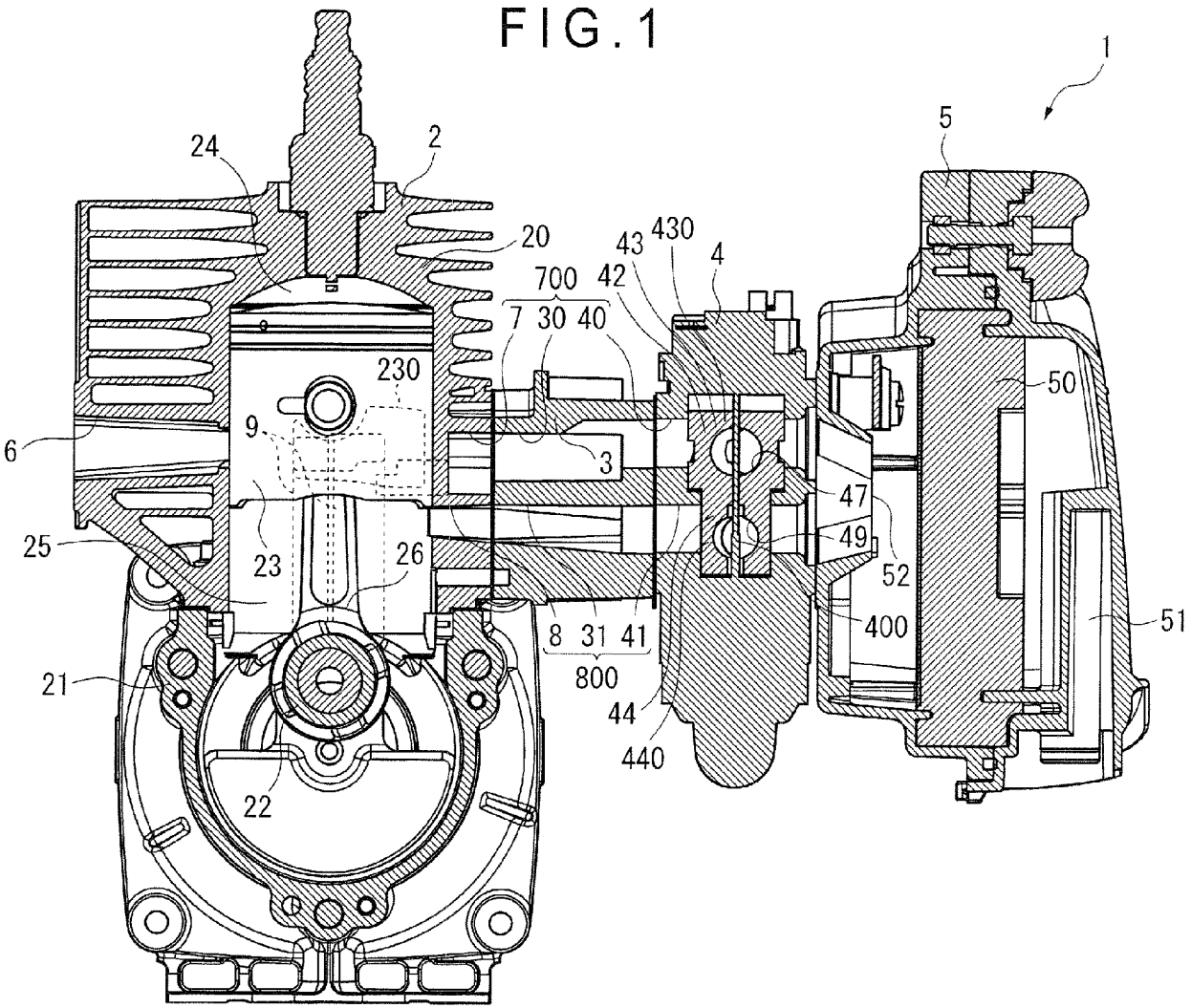
FIG. 1 is a cross sectional side view illustrating a structure of a two-cycle engine according to a first exemplary embodiment of the invention.
Figure 2:
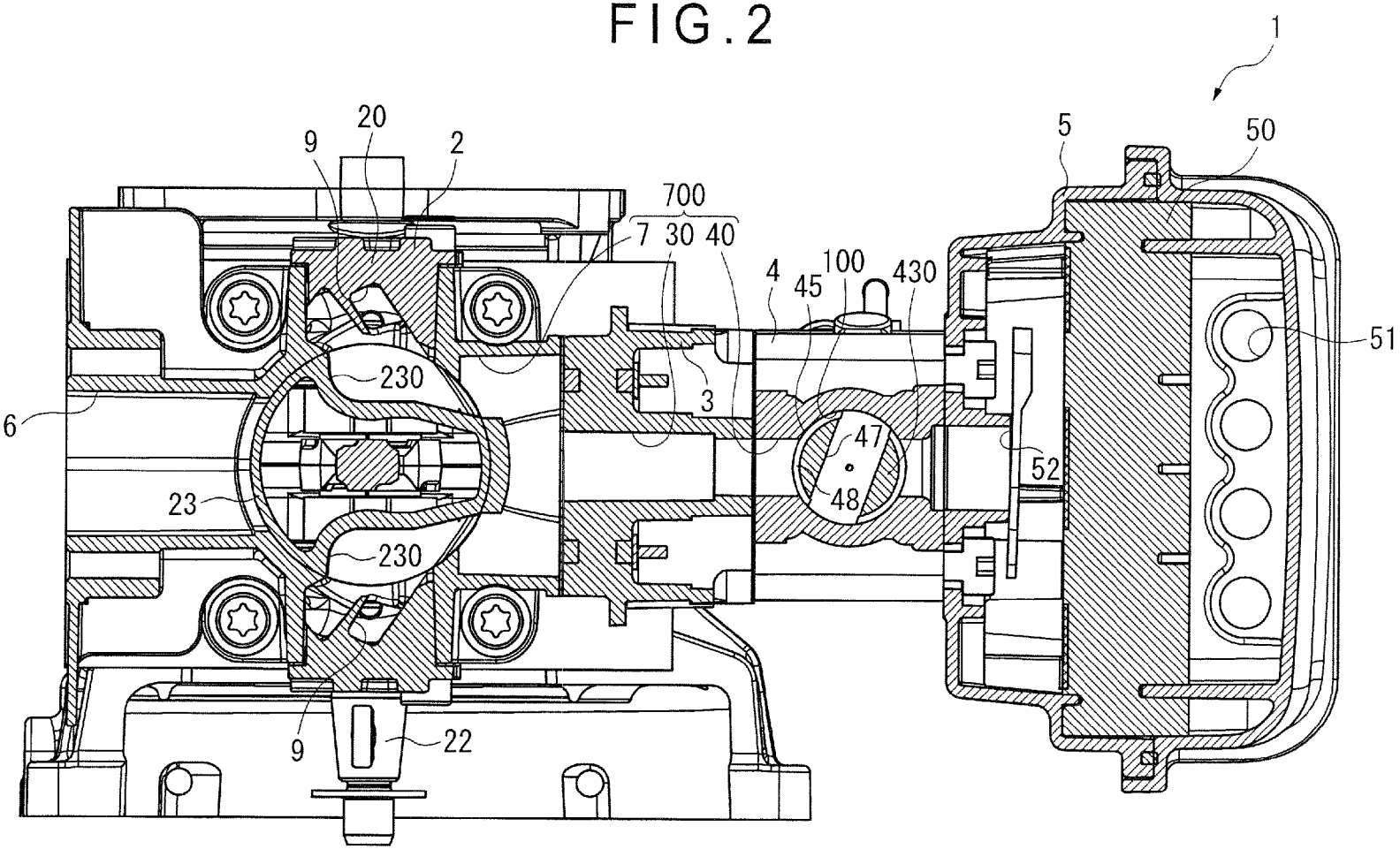
FIG. 2 is a cross sectional view illustrating the structure of the two-cycle engine according to the first exemplary embodiment.

FIG. 1 is a cross sectional side view and FIG. 2 is a cross sectional view respectively illustrating a structure of a two-cycle engine 1 according to the first exemplary embodiment.

As shown in FIGS. 1 and 2, the stratified scavenging two-cycle engine 1 includes an engine body 2, an insulator 3, a carburetor 4 and an air cleaner 5.

The engine body 2 includes a cylinder 20, a crankcase 21 provided on a lower portion of the cylinder 20, a crankshaft 22 supported by the crankcase 21, and a piston 23 connected to the crankshaft 22 through a connecting rod 26 and slidably inserted to the cylinder 20. An upper side of the piston 23 divides an interior of the cylinder 20 into an upper space and a lower space. The upper space defines a cylinder chamber 24, and the lower space and an inner space of the crankcase 21 define a crank chamber 25.

The cylinder 20 includes an exhaust passage 6 which is apertured on an inner circumference of the cylinder 20, a cylinder air passage 7 which is apertured on the inner circumference of the cylinder 20 and is provided at a position facing the exhaust passage 6 to interpose the piston 23 therebetween, a cylinder mixture passage 8 which is apertured on the inner circumference of the cylinder 20 and is provided below the cylinder air passage 7, and a pair of scavenging passages 9 which are apertured on the inner circumference of the cylinder 20 and are provided at a position circumferentially shifted by 90 degree from the exhaust passage 6 and the cylinder air passage 7 as shown in FIG. 2. The pair of scavenging passages 9 are connectable to the cylinder air passage 7 through a pair of grooves 230 provided on an outer circumference of the piston 23. In a scavenging process, the pair of scavenging passages 9 are connected to the cylinder chamber 24 and the crank chamber 25. A piston valve method is employed as an intake method of the air-fuel mixture for controlling the intake of the air-fuel mixture by opening and closing the cylinder mixture passage 8 on the outer circumference of the piston 23.

As shown in FIG. 1, the insulator 3 is a synthetic resin member for controlling heat transfer from the engine body 2 to the carburetor 4. The insulator 3 includes an insulator air passage 30 that communicates with the cylinder air passage 7 of the engine body 2 on an upper side of the insulator 3 and an insulator mixture passage 31 that communicates with the cylinder mixture passage 8 of the engine body 2 on a lower side of the insulator 3.

The carburetor 4 is attached to the engine body 2 through the insulator 3. The air cleaner 5 is attached on an upper stream side of the carburetor 4 (a right side in FIG. 1). The carburetor 4 includes a carburetor air passage 40 which has a venturi-shaped portion on a side close to the air cleaner 5 and which is connected to the insulator air passage 30 on the other side close to the insulator 3, and a carburetor mixture passage 41 which also has a venturi-shaped portion on one side close to the air cleaner 5 and which is connected to the insulator mixture passage 31 on the other side close to the insulator 3. A rotary valve 42 for opening and closing the respective passages 40 and 41 is rotatably fitted to a fitting hole 45 (FIG. 2).

Figure 3:
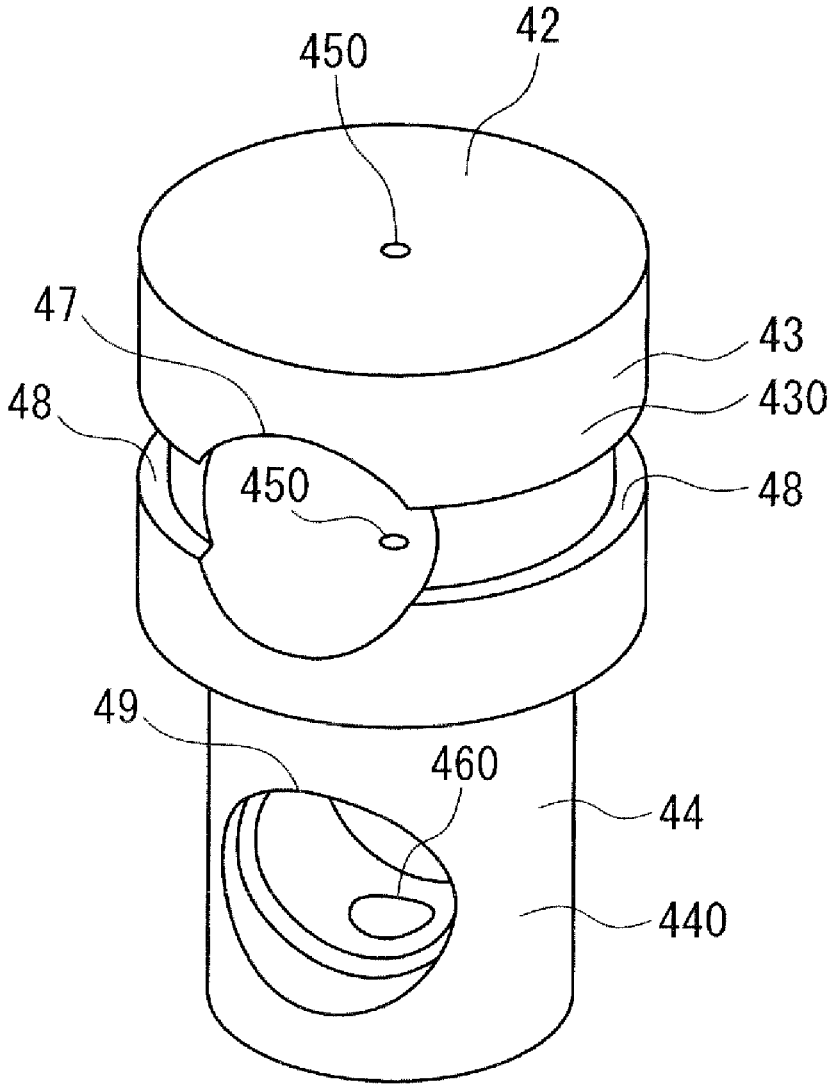
FIG. 3 is a perspective view illustrating a rotary valve according to the first exemplary embodiment.

FIG. 3 is a perspective view illustrating the rotary valve 42.

As shown in FIG. 3, the rotary valve 42 is integrally formed by a large-diameter column 43 and a small-diameter column 44 provided below the large-diameter column 43. Insert holes 450 and 460 for a fuel supply section 400 (FIG. 5) including a jet needle and a needle jet are formed at a rotation center of the rotary valve 42. A through hole 47 radially penetrating the rotary valve 42 is formed on the large-diameter column 43 and a pair of grooves. 48 are circumferentially provided on an outer circumference of the large-diameter column 43 to intercommunicate between one aperture and the other aperture of the through hole 47. A radially penetrating through hole 49 is formed on the small-diameter column 44.

The rotary valve 42 is rotated by a throttle lever (not shown) for accelerator operation thereof. Specifically, the large-diameter column 43 opens and closes the carburetor air passage 40 by the outer circumference of the large-diameter column 43 and the through hole 47 while working as a rotary air valve 430 that adjusts the intake amount of base air of the air-fuel mixture in accordance with an opening degree of the through hole 47. Similarly, the small-diameter column 44 opens and closes the carburetor mixture passage 41 by the outer circumference of the small-diameter column 44 and the through hole 49 while working as a rotary mixture valve 440 that adjusts the intake amount of the base air of the air-fuel mixture in accordance with the opening degree of the through hole 49.

Figure 4:
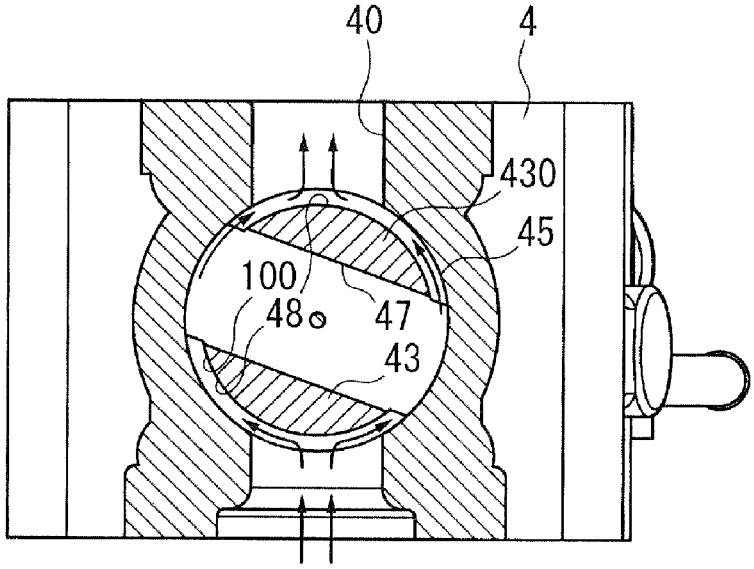
FIG. 4 is an enlarged view illustrating an air valve during idling according to the first exemplary embodiment.
Figure 5:
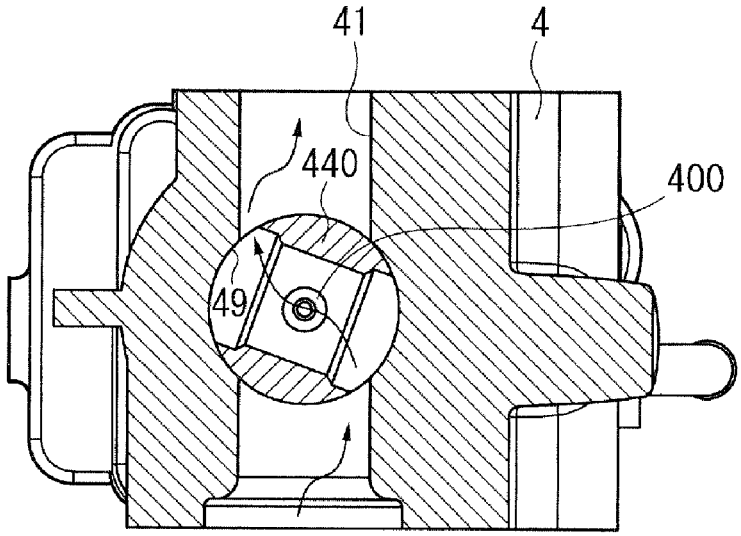
FIG. 5 is an enlarged view illustrating a mixture valve during idling according to the first exemplary embodiment.

FIG. 4 is an enlarged view illustrating the air valve 430 during idling and FIG. 5 is an enlarged view illustrating the mixture valve 440 during idling.

Although the through hole 47 is opened during normal operation in the air valve 430, the through hole 47 is completely closed during idling as shown in FIG. 4. At this time, an auxiliary air passage 100 defined by the pair of grooves 48 provided on the outer circumference of the large-diameter column 43, an inner surface of the fitting hole 45, and the through hole 47 to intercommunicate between one side close to the air cleaner 5 and the other side close to the engine body 2 of the carburetor air passage 40, so that a small amount of the pure air passes through the auxiliary air passage 100.

On the other hand, as shown in FIG. 5, air that passes through the mixture valve 440 forms the air-fuel mixture after a fuel is supplied from the fuel supply section 400. During idling, an opening degree of the mixture valve 440 is more restricted than that of a conventional stratified scavenging two-cycle engine. Although the mixture valve 440 reduces the amount of intake air, the mixture valve 440 is capable of feeding the air passing through the mixture valve 440 with the fuel amount substantially equal to that of the conventional engine. In other words, the mixture valve 440 is adjusted to supply the concentrated air-fuel mixture during idling. In this exemplary embodiment, the carburetor air passage 40, the insulator air passage 30 and the cylinder air passage 7 define an air passage 700, and the carburetor mixture passage 41, the insulator mixture passage 31 and the cylinder mixture passage 8 define a mixture passage 800.

As shown in FIGS. 1 and 2, the air cleaner 5 includes an air-cleaner element 50 therein. The air cleaner S is provided with an air inlet duct 51 that communicates with an outside and an intake duct 52 that communicates with the carburetor air passage 40 and the carburetor mixture passage 41 of the carburetor 4. The pure air and the base air of the air-fuel mixture are firstly sucked from the air inlet duct 51 to pass through the air-cleaner element 50 and fed into the carburetor air passage 40 and the carburetor mixture passage 41 of the carburetor 4 through the intake duct 52.

Operation and advantages of the engine 1 will be described below.

Figure 6A:
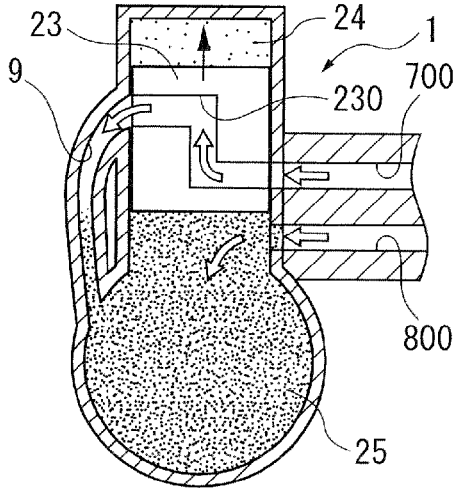
FIG. 6A is a schematic diagram illustrating operation and advantages of the two-cycle engine according to the first exemplary embodiment.

During idling, the air valve 430 is completely closed while the mixture valve 440 is adjusted to have a restricted opening degree in the engine 1. In an intake process as shown in FIG. 6A, after the air amount is reduced by adjusting the mixture valve 440 to concentrate the air-fuel mixture, the densely concentrated air-fuel mixture is fed into the crank chamber 25 from the mixture passage 800 while the reduced air as the pure air is fed into the scavenging passage 9 from the air passage 700 through the groove 230 penetrating the piston 23.

Figure 6B:
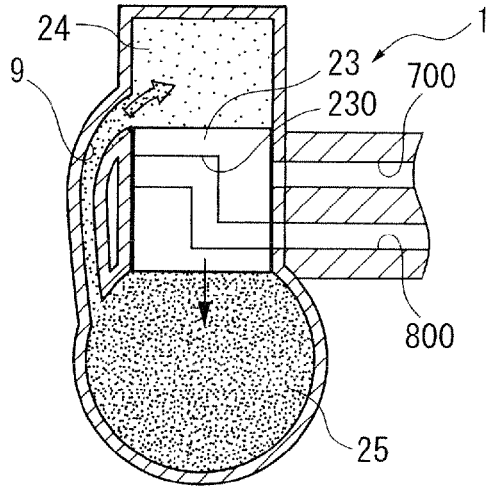
FIG. 6B is another schematic diagram illustrating the operation and advantages of the two-cycle engine according to the first exemplary embodiment.

Then, in a scavenging process as shown in FIG. 6B, the densely concentrated air-fuel mixture sucked in the crank chamber 25 is fed into the cylinder chamber 24 to be mixed with a part of the pure air residing in the cylinder chamber 24. Accordingly, the concentration of the air-fuel mixture in the cylinder chamber 24 becomes substantially equal to the concentration of the air-fuel mixture in the cylinder chamber 24 during idling (FIG. 19) of the conventional stratified scavenging two cycle engine.

Conventionally, all of the air has been used as air-fuel mixture during idling. However, in this exemplary embodiment, the amount of the base air of the air-fuel mixture is reduced and the air that supplements the reduced amount of the base air is directly fed into the cylinder chamber 24 as the pure air through the auxiliary air passage 100, the air passage 700 and the scavenging passage 9. Accordingly, the air amount and the fuel amount sucked in the engine 1 are equal to those in the conventional engine, whereby fuel consumption is not degraded.

Figure 6C:
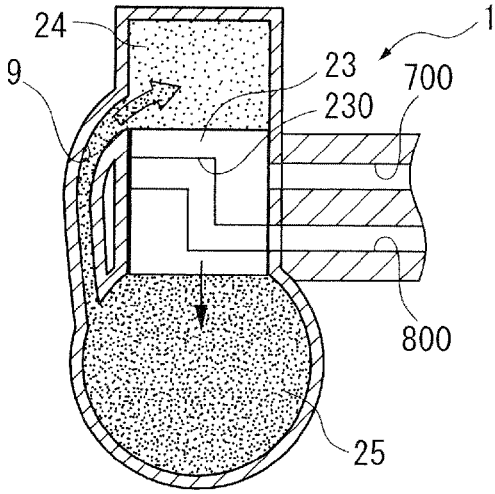
FIG. 6C is still another schematic diagram illustrating the operation and advantages of the two-cycle engine according to the first exemplary embodiment.

When being suddenly accelerated from the idling state, the rotary valve 42 is rotated by the throttle lever (not shown) such that both of the air valve 430 and the mixture valve 440 are opened. The air-fuel mixture is fed into the crank chamber 25 while the pure air is fed into the scavenging passage 9 in the intake process. At this time, a great amount of the concentrated air-fuel mixture sucked during idling resides in the crank chamber 25. In the scavenging process as shown in FIG. 6C, the residual concentrated air-fuel mixture is fed into the cylinder chamber 24 so that the concentration of the air-fuel mixture in the cylinder chamber 24 is sufficient for acceleration even after the air-fuel mixture is mixed with the part of the pure air to be diluted in the cylinder chamber 24, which enables the engine 1 to be smoothly accelerated.

Further, since the pair of grooves 48 provided on the outer circumference of the large-diameter column 43, the inner surface of the fitting hole 45, and the through hole 47 define the auxiliary air passage 100, a constant pure air is sucked from the auxiliary air passage 100 with a simple structure during idling.

Although the air valve 430 is completely closed with the through hole 47 at zero opening degree according to the exemplary embodiment, the air valve 430 may be slightly opened to pass the pure air. As long as the amount of the base air of the air-fuel mixture is reduced by the mixture valve 440 while an amount of air that supplements the reduced amount of the base air is supplied from the auxiliary air passage 100 and the air valve 430 similarly to the exemplary embodiment as described above, the air amount and the fuel amount fed into the engine 1 during idling are equal to those in the conventional engine and the great amount of densely concentrated air-fuel mixture resides in the crank chamber 25 in sudden acceleration from the idling state, so that the same advantages as in the exemplary embodiment can be attained. When the same advantages as in the exemplary embodiment can be attained even though the air valve 430 is slightly opened, such a state of the air valve 430 is referred to as a minimally opened state of the air valve 430.

Second Exemplary Embodiment

Figure 7:
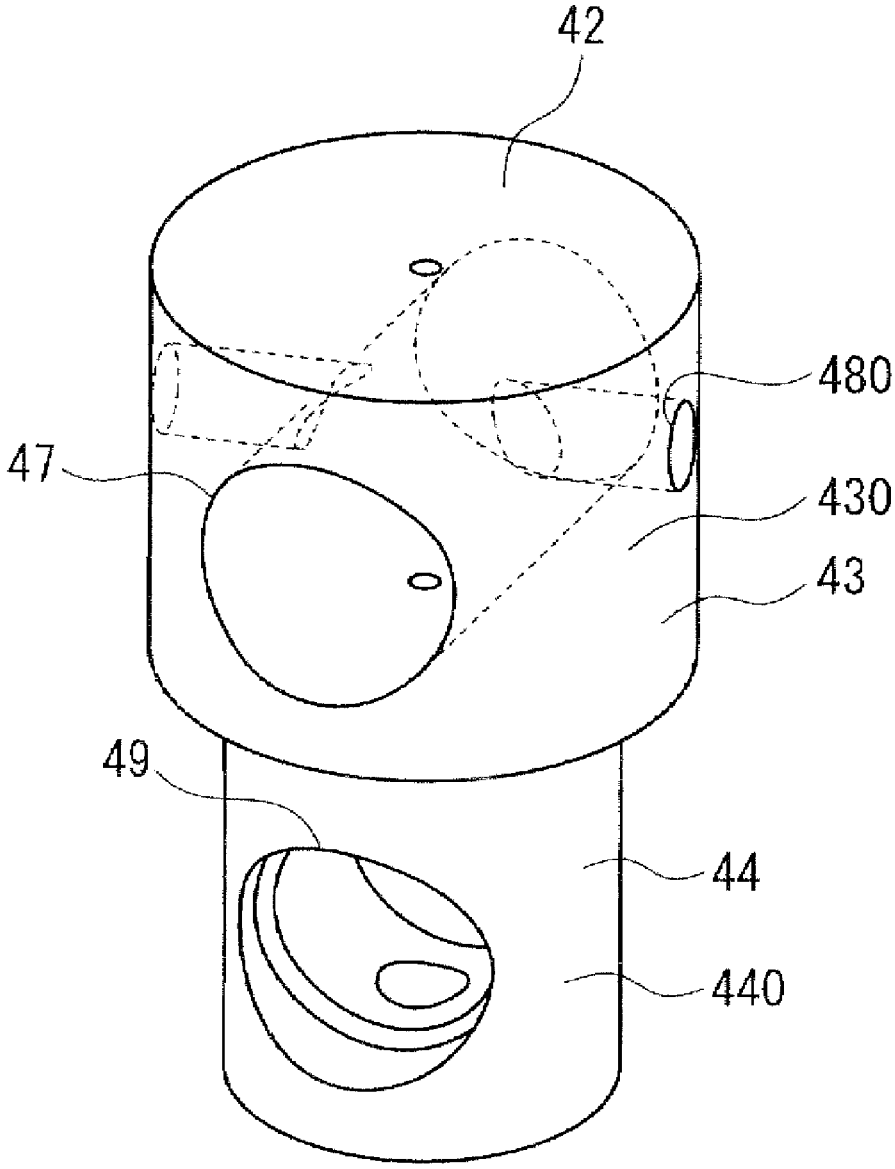
FIG. 7 is a perspective view illustrating a rotary valve according to a second exemplary embodiment of the invention.
Figure 8:
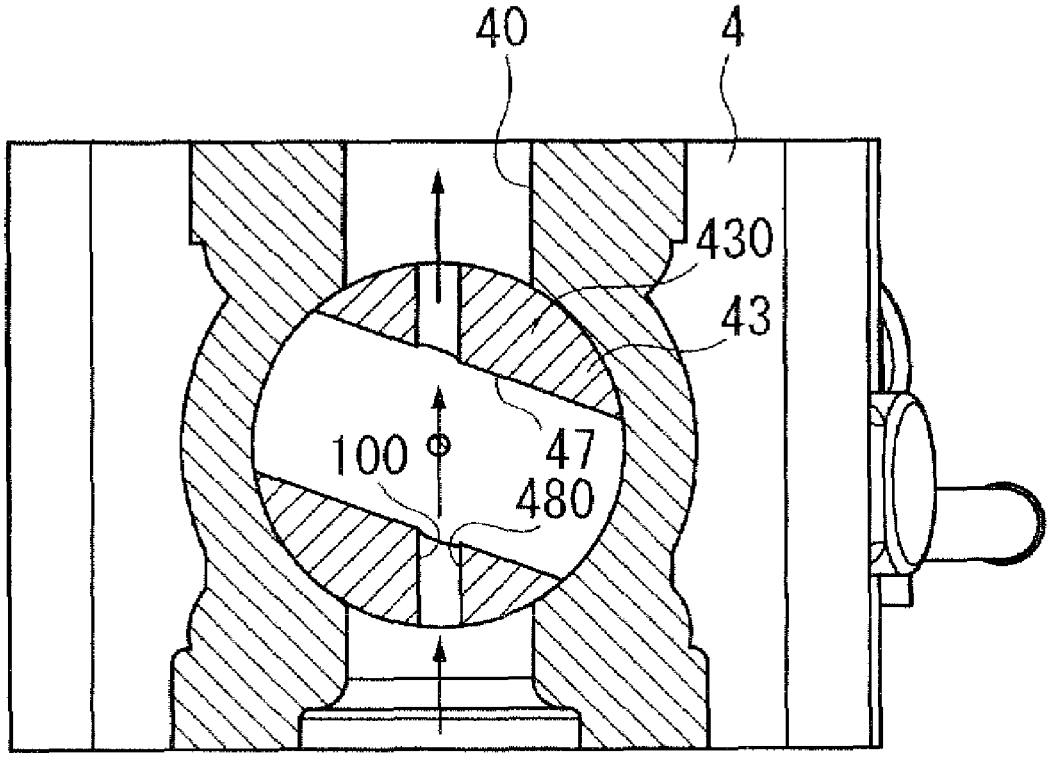
FIG. 8 is an enlarged view illustrating an air valve during idling according to the second exemplary embodiment.

FIG. 7 is a perspective view illustrating the rotary valve 42 according to a second exemplary embodiment and FIG. 8 is an enlarged view illustrating the air valve 430 during idling. In the following description, the same members and functional portions as those of the first exemplary embodiment will be denoted by the same reference numerals, and the description thereof will be omitted or simplified.

In the second exemplary embodiment as shown in FIG. 7, a small bole 480, in place of the grooves 48 of the first exemplary embodiment, is provided in the large-diameter column 43 of the rotary valve 42. During idling, the opening degree and the like of the mixture valve 440 are adjusted in the same manner as in the first exemplary embodiment.

As shown in FIG. 8, the small hole 480 radially penetrates the air valve 430 to be substantially parallel to the carburetor air passage 40 when the air valve 430 is completely closed during idling.

The small hole 480 and the through hole 47 define the auxiliary air passage 100. Therefore, when the air valve 430 is completely closed or minimally opened during idling, the engine 1 is made capable of feeding the pure air to the scavenging passage 9. Similarly to the first exemplary embodiment, the engine 1 can be smoothly accelerated in sudden acceleration from the idling state while the amount of the air and the fuel sucked in the engine 1 is equal to that in the conventional engine. Further, the small hole 480 provided in the large-diameter column 43 and the though hole 47 define the auxiliary air passage 100, whereby the constant pure air is sucked from the auxiliary air passage 100 with a simple structure during idling similarly to the first exemplary embodiment.

Third Exemplary Embodiment

Figure 9:
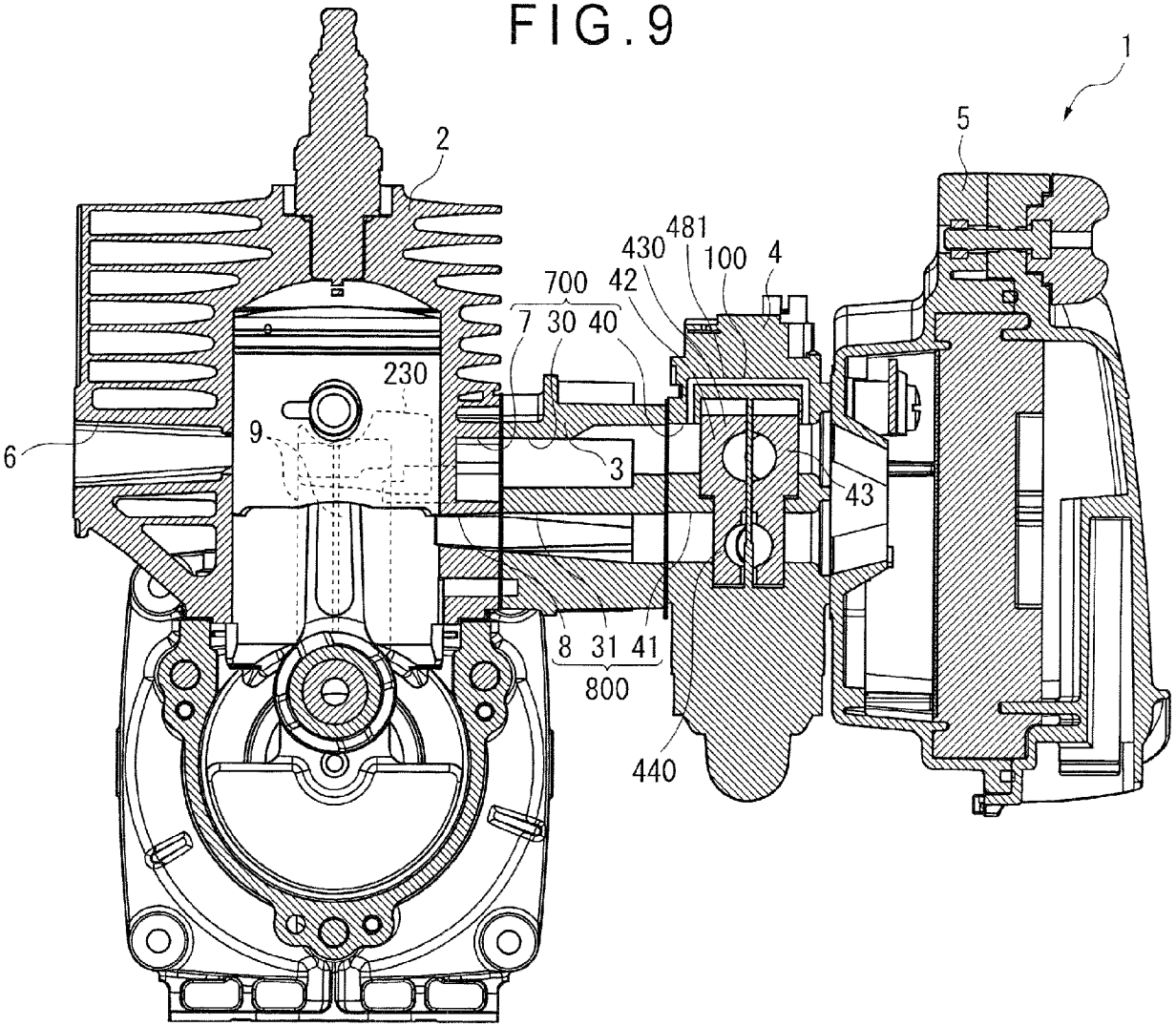
FIG. 9 is a cross sectional view illustrating a two-cycle engine according to a third exemplary embodiment of the invention.
Figure 10:
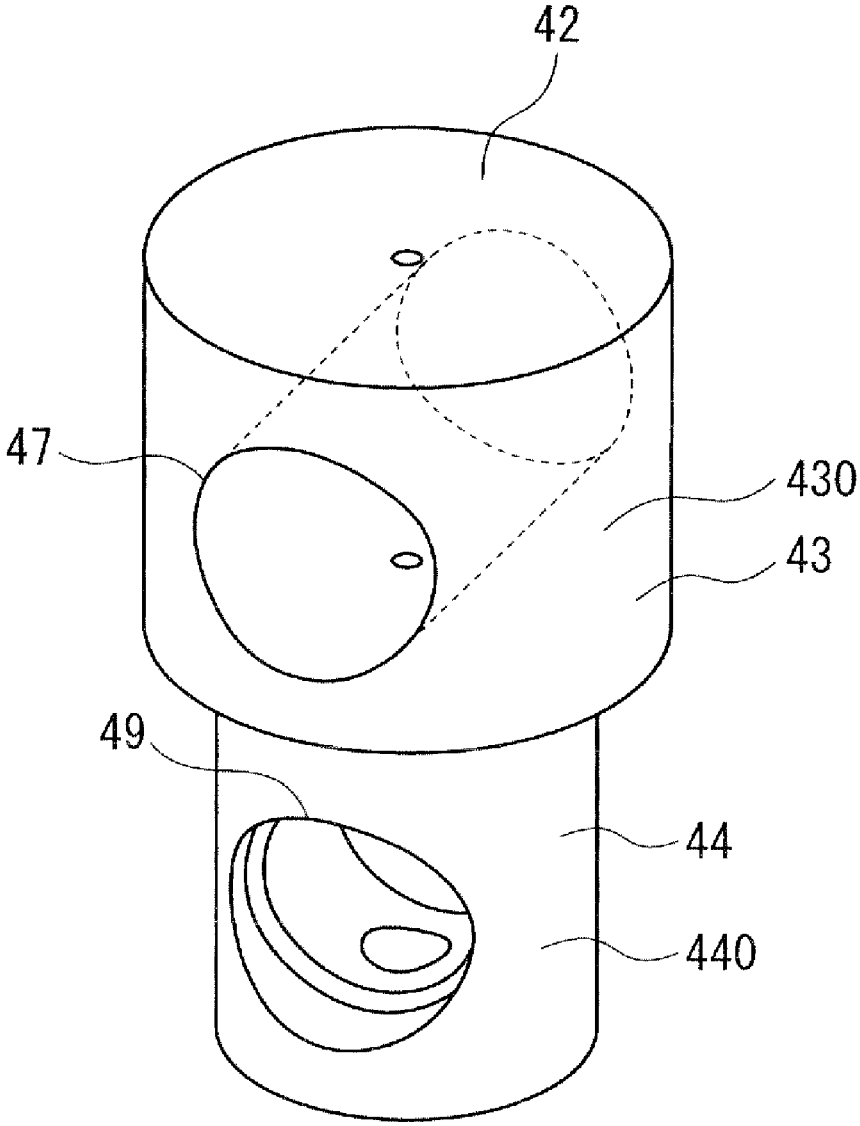
FIG. 10 is a perspective view illustrating a rotary valve according to the third exemplary embodiment.
Figure 11:
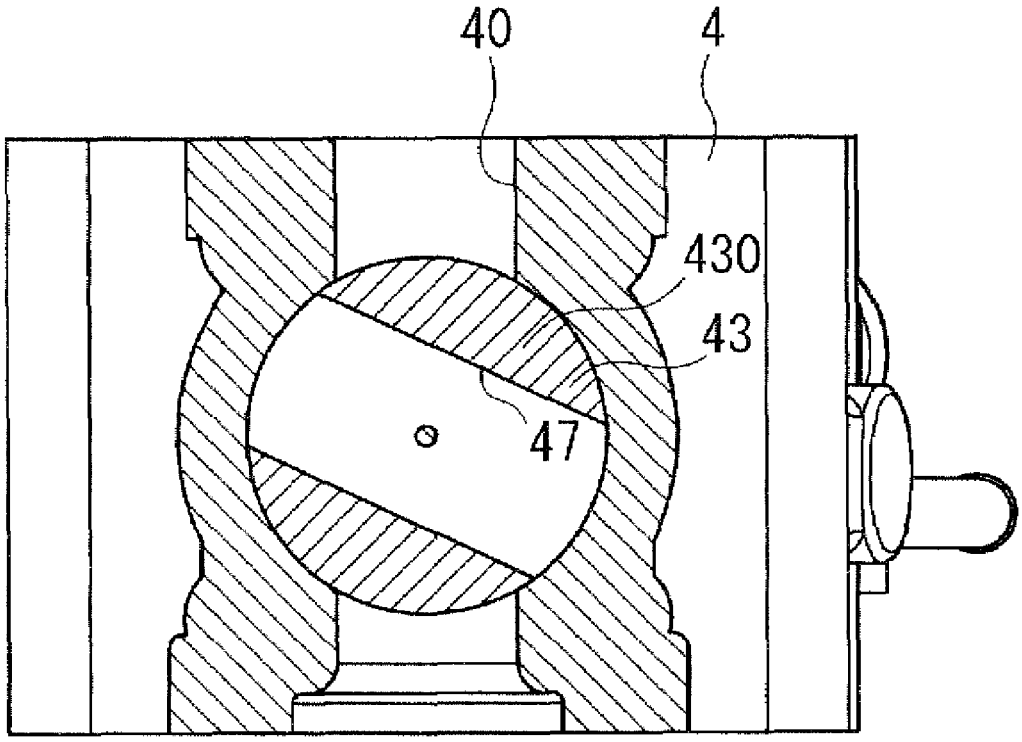
FIG. 11 is an enlarged view illustrating an air valve during idling according to the third exemplary embodiment.

FIG. 9 is a cross sectional view illustrating the engine 1, FIG. 10 is a perspective view illustrating the rotary valve 42, and FIG. 11 is an enlarged view illustrating the air valve 430 during idling according to a third exemplary embodiment of the invention.

As shown in FIG. 9, a tubular passage 481 is provided in a thick portion of the carburetor 4 over the rotary valve 42 to intercommunicate between a side close to the air cleaner 5 of the carburetor air passage 40 and the other side close to the engine 2 for defining the auxiliary air passage 100. Therefore, the rotary valve 42 is the same as a conventional rotary valve, in which only the through hole 47 is provided to pass the pure air as shown in FIG. 10.

Although the pure air cannot pass the large-diameter column 43 during idling as shown in FIG. 11 according to this exemplary embodiment, the auxiliary air passage 100 provided in the thick portion of the carburetor 4 allows the pure air to pass. Accordingly, the engine 1 is capable of feeding the pure air to the scavenging passage 9 so that the same advantages as in the first exemplary embodiment can be attained.

Fourth Exemplary Embodiment

Figure 12:
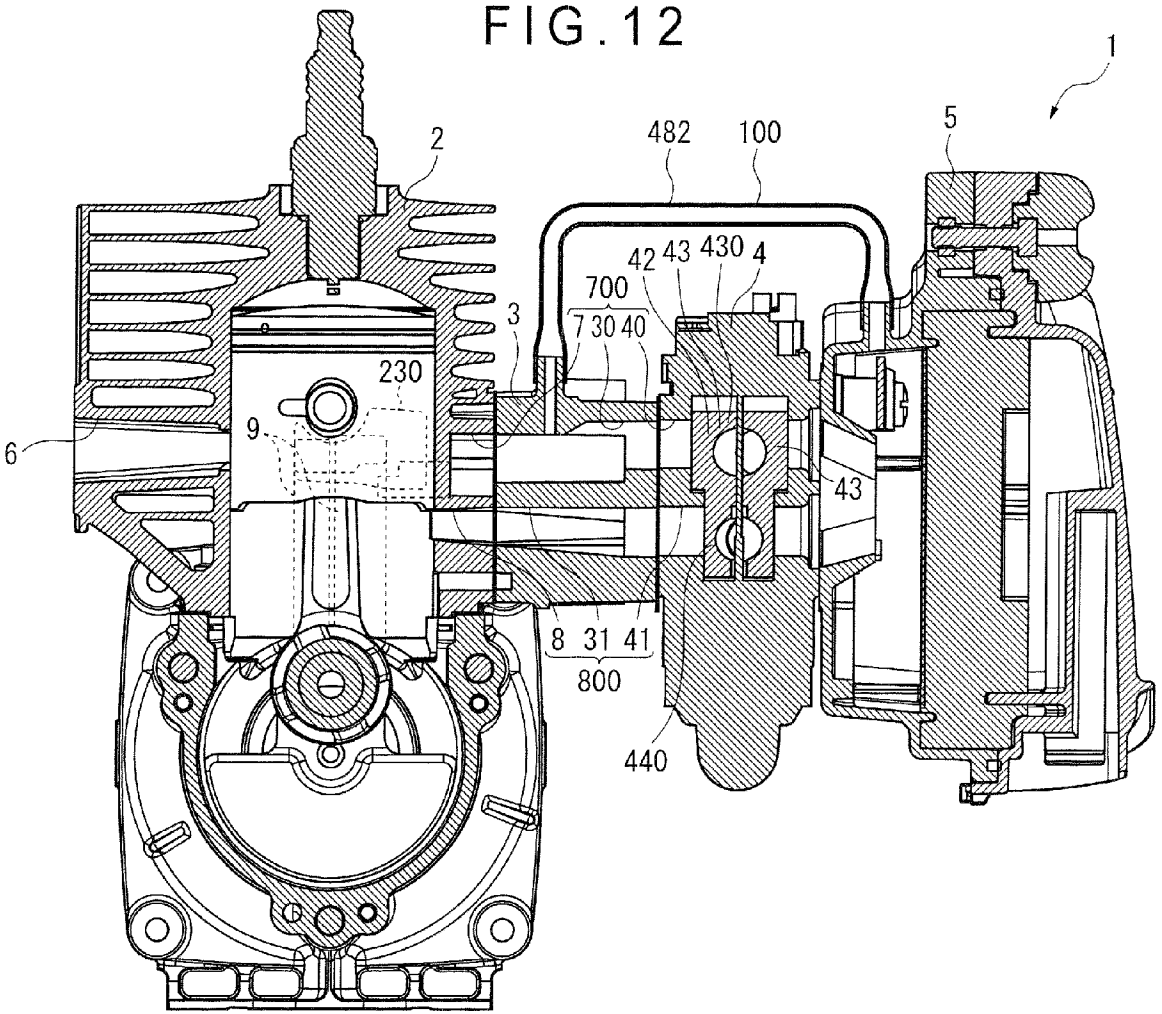
FIG. 12 is a cross sectional view illustrating a structure of a two-cycle engine according to a fourth exemplary embodiment of the invention.

The engine 1 according to a fourth exemplary embodiment as shown in FIG. 12 features that a pipe 482 is provided over the air cleaner 5 and the insulator 3 outside of the carburetor 4 to feed the air directly into the insulator air passage 30 without allowing a part of the air that passes through the air-cleaner element 50 to pass through the large-diameter column 43.

In the fourth exemplary embodiment, the auxiliary air passage 100 includes the pipe 482 to intercommunicate between the downstream side-of the air-cleaner element 50 and the insulator air passage 30 so that the same advantages as in the first exemplary embodiment as described above can be attained. Since it is only required that the pipe 482 is attached to the engine 1, a structure thereof can be further simplified and manufacturing thereof is facilitated.

Fifth Exemplary Embodiment

Figure 13:
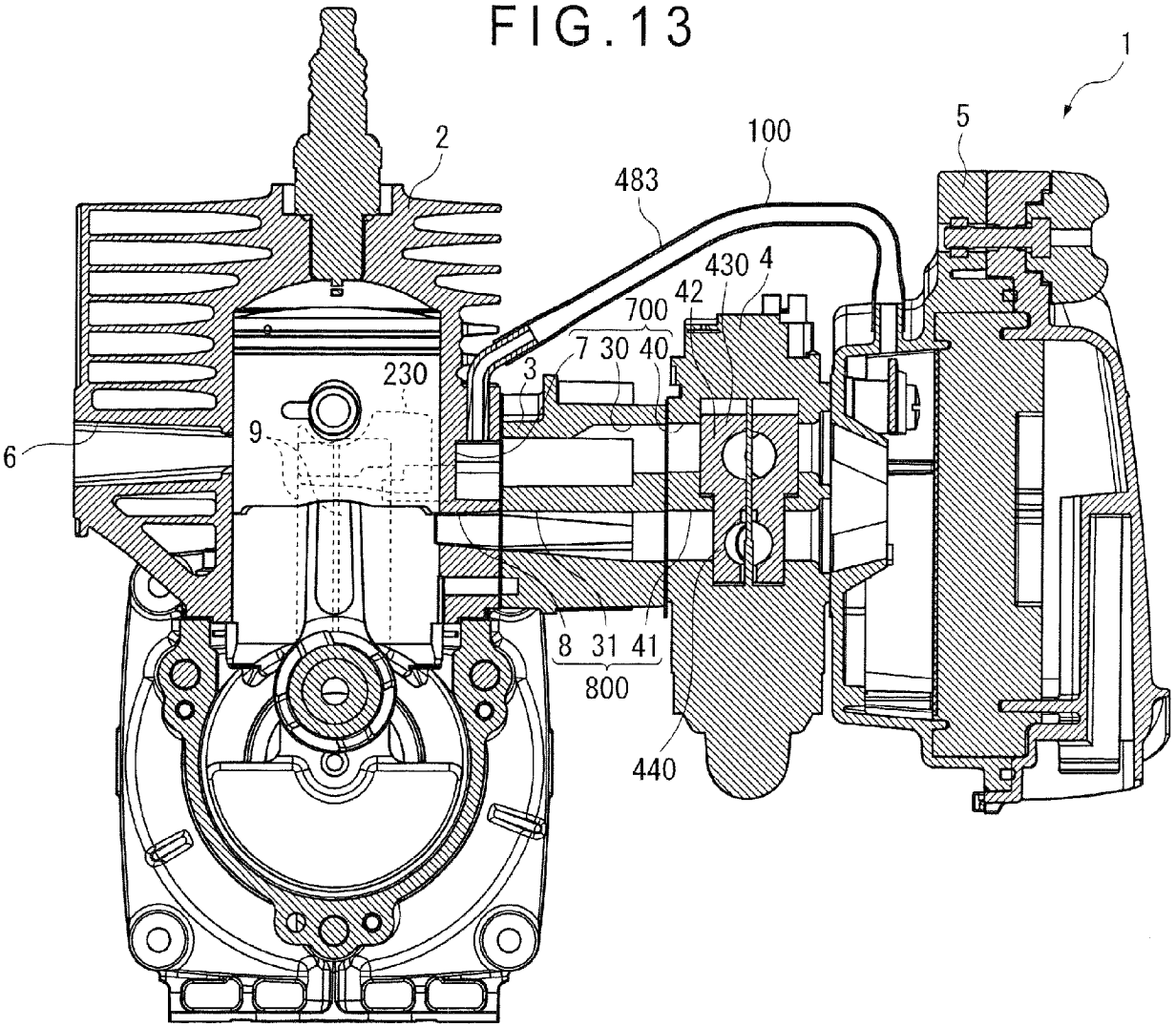
FIG. 13 is a cross sectional view illustrating a structure of a two-cycle engine according to a fifth exemplary embodiment of the invention.

The engine 1 according to a fifth exemplary embodiment as shown in FIG. 13 features that a pipe 483 is provided such that one end thereof is attached to the air cleaner 5 and the other end thereof is attached to the engine body 2 in place of the insulator 3, unlike the fourth exemplary embodiment.

Since the auxiliary air passage 100 for delivering a part of the air on a downstream side of the air-cleaner element 50 directly into the cylinder air passage 7 includes the pipe 483 in the fifth exemplary embodiment, the same advantages as in the first exemplary embodiment as described above can be attained.

Sixth Exemplary Embodiment

Figure 14:
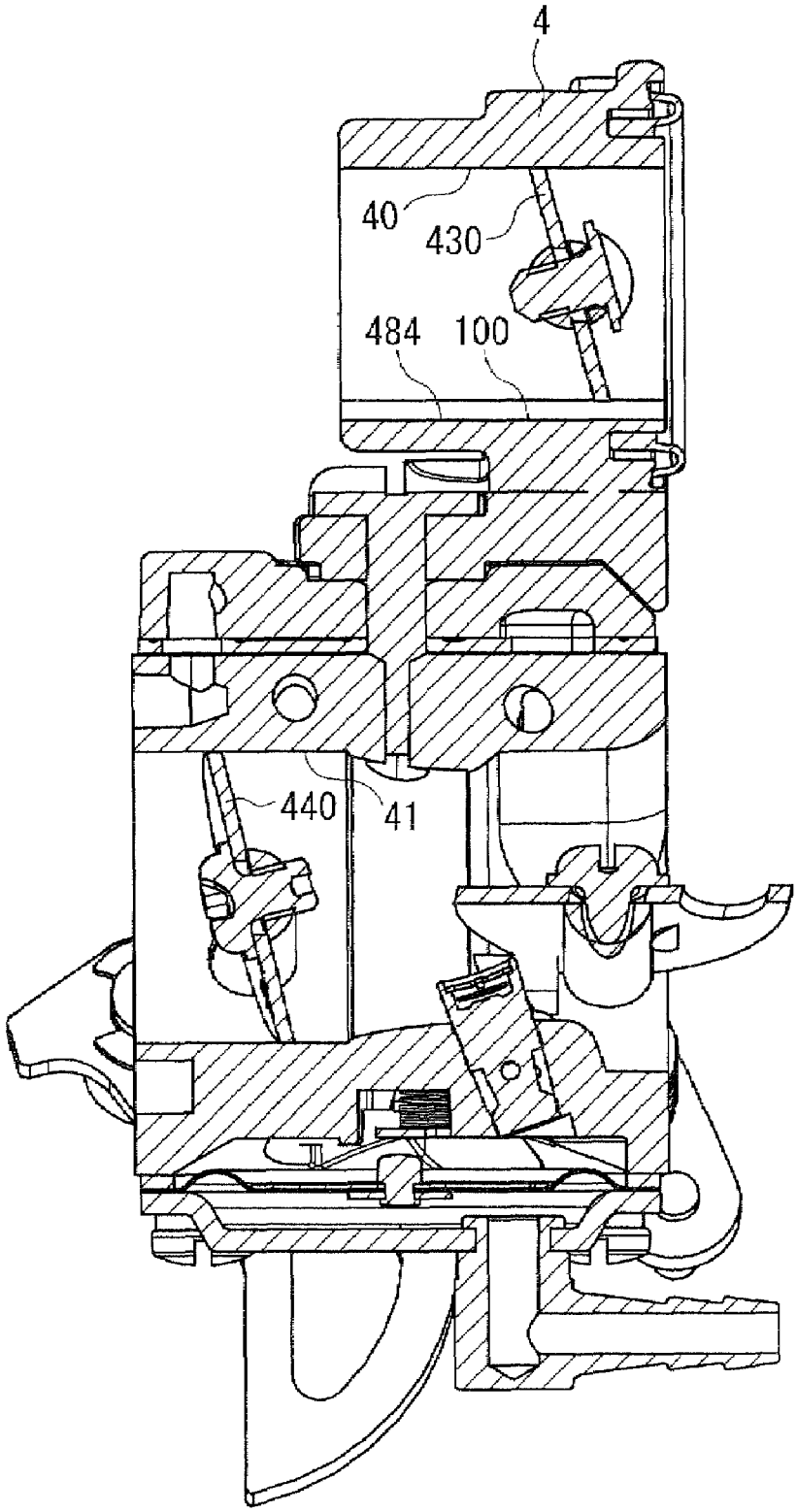
FIG. 14 is a cross sectional view illustrating a carburetor during idling according to a sixth exemplary embodiment of the invention.
Figure 15:
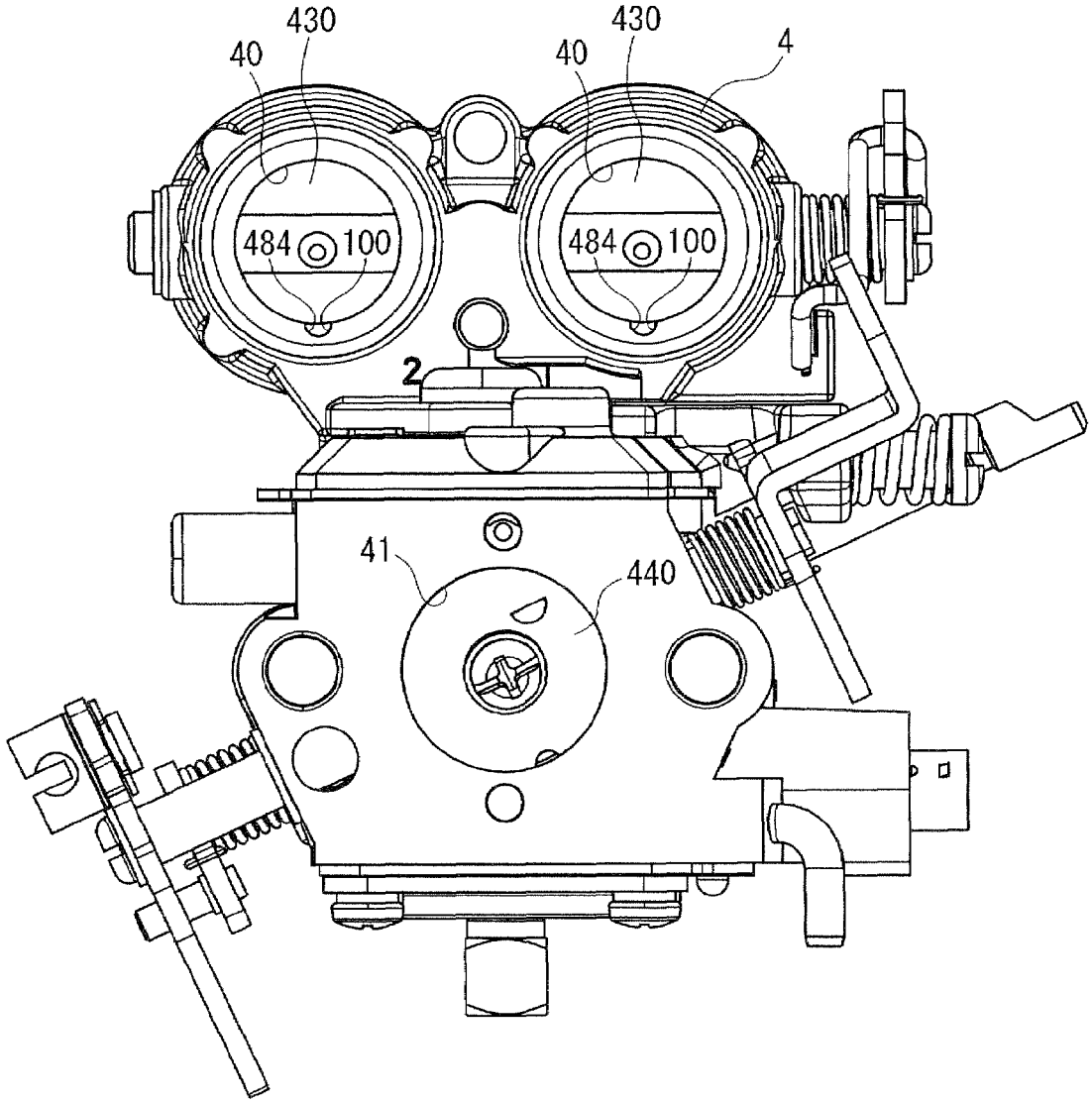
FIG. 15 illustrates the carburetor during idling as viewed from a side close to an insulator according to the sixth exemplary embodiment.

FIG. 14 is a cross sectional side view illustrating the carburetor 4 during idling and FIG. 15 illustrates the carburetor 4 during idling as viewed from a side close to the insulator 3 according to a sixth exemplary embodiment.

As shown in FIGS. 14 and 15, the carburetor 4 according to this exemplary embodiment includes the carburetor air passages 40 provided in parallel to each other. Both of the air valves 430 and the mixture valve 440 are butterfly valves. On inner circumferences of the carburetor air passages 40, grooves 484 are provided along a communicating direction of the carburetor air passages 40.

Since the auxiliary air passages 100 include the grooves 484, the auxiliary air passages 100 allow the pure air to pass and the engine 1 is made capable of delivering the pure air into the scavenging passage 9 even when the air valves 430 are completely closed or minimally opened during idling. Thus, the same advantages as in the first exemplary, embodiment can be attained.

Seventh Exemplary Embodiment

Figure 16:
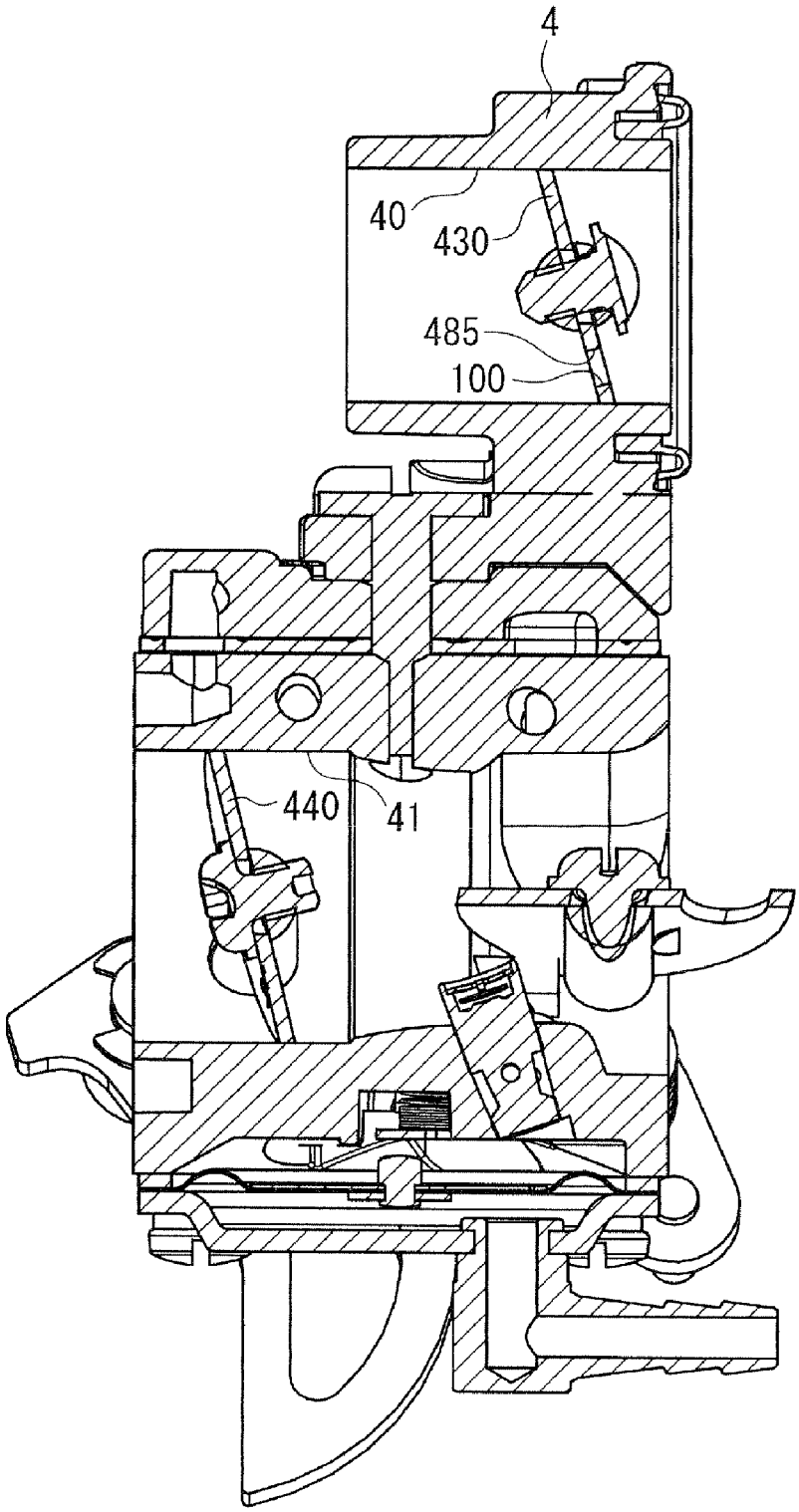
FIG. 16 is a cross sectional side view illustrating a carburetor during idling according to a seventh exemplary embodiment.
Figure 17:
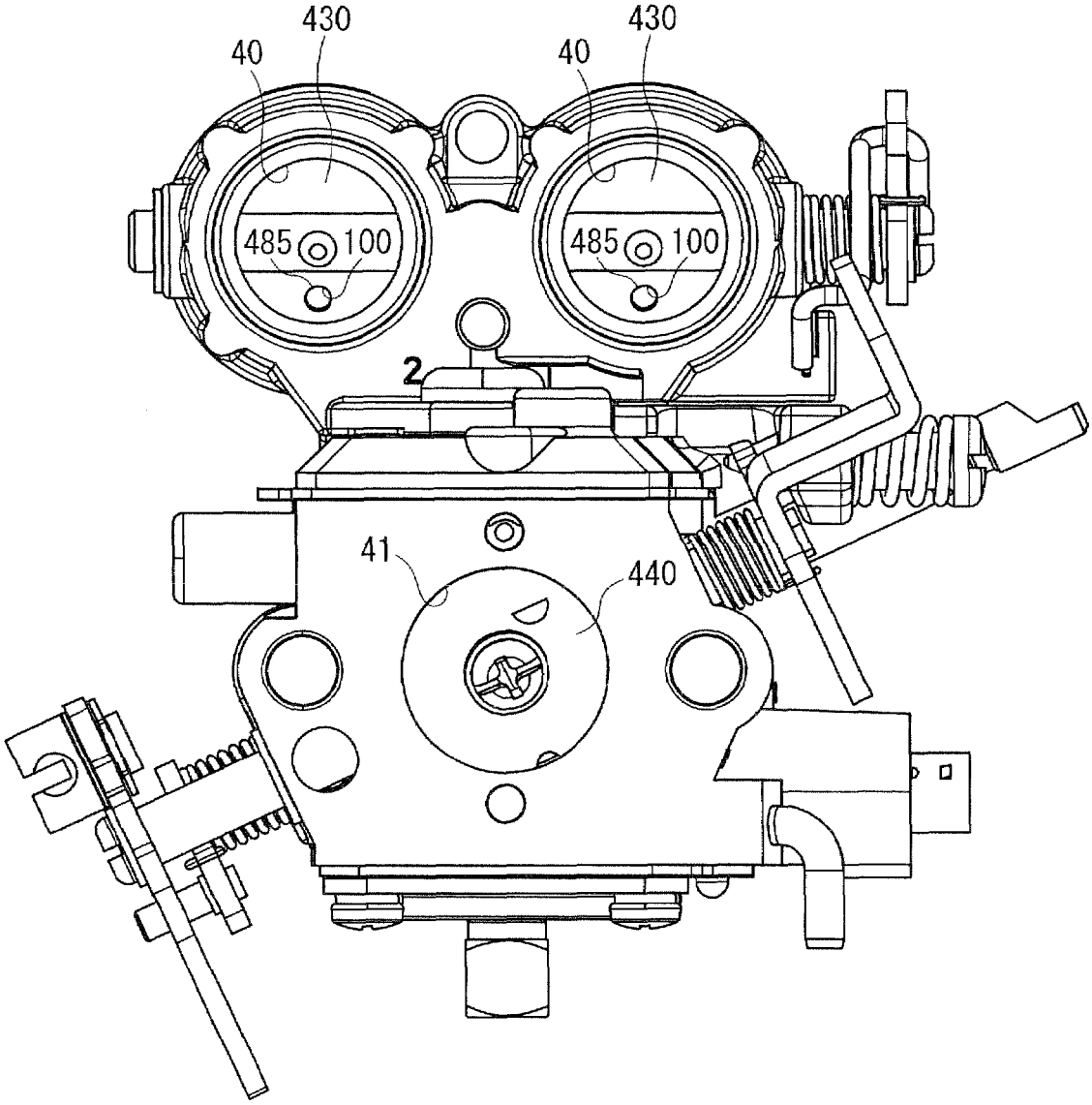
FIG. 17 illustrates the carburetor during idling as viewed from a side close to an insulator according to the seventh exemplary embodiment.

FIG. 16 is a cross sectional side view illustrating the carburetor 4 during idling and FIG. 17 illustrates the carburetor 4 during idling as viewed from a side close to the insulator 3 according to a seventh exemplary embodiment.

As shown in FIGS. 16 and 17, the air valves 430 provided in the carburetor 4 and the mixture valve 440 are butterfly valves similarly to the sixth exemplary embodiment, and each of the air valves 430 includes each of small holes 485 that penetrate the air valves 430.

In the seventh exemplary embodiment, each of the auxiliary air passages 100 is defined by each of the small holes 485, so that the same advantages as in the first exemplary embodiment can be attained.

Eight Exemplary Embodiment

Figure 18:
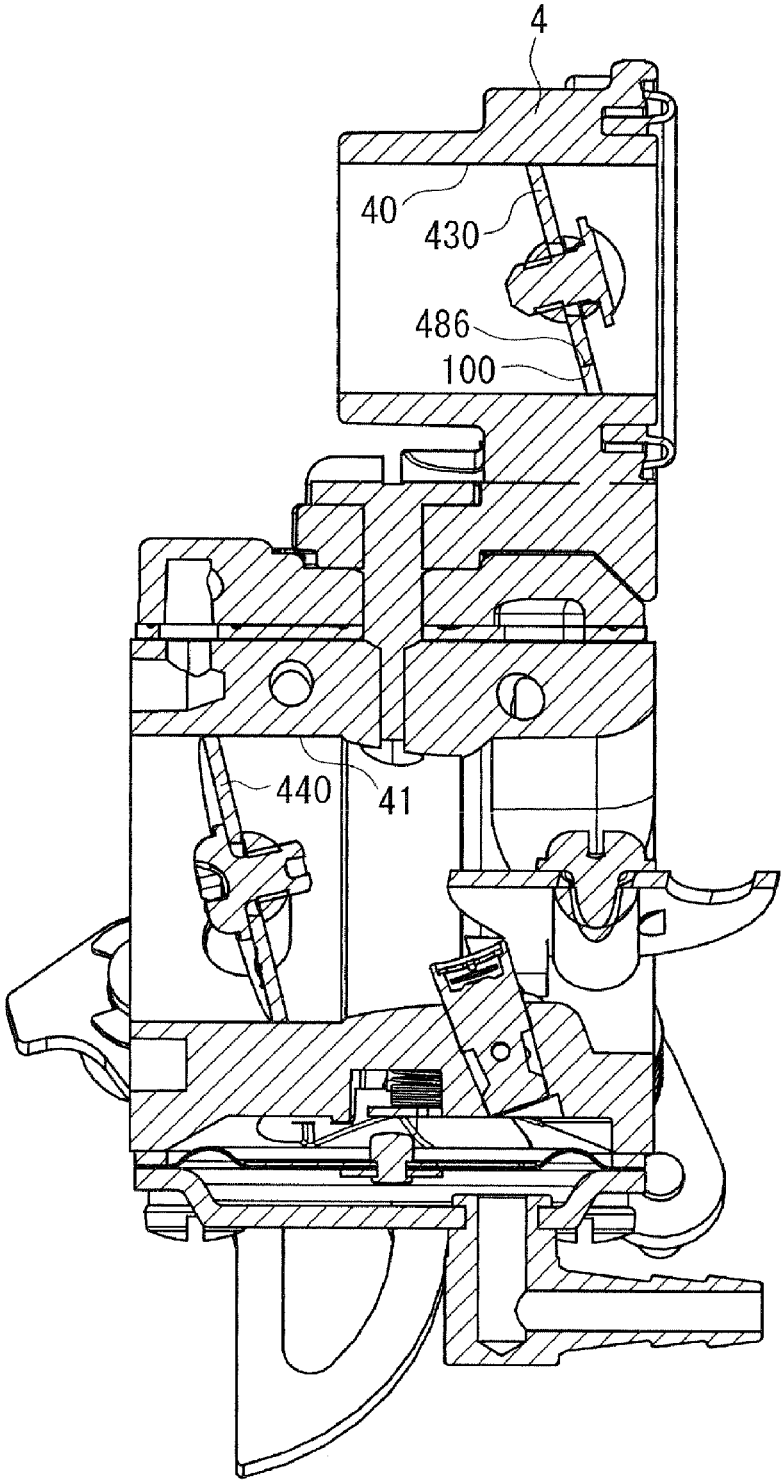
FIG. 18 is a cross sectional side view illustrating a carburetor during idling according to an eighth exemplary embodiment.
Figure 19:
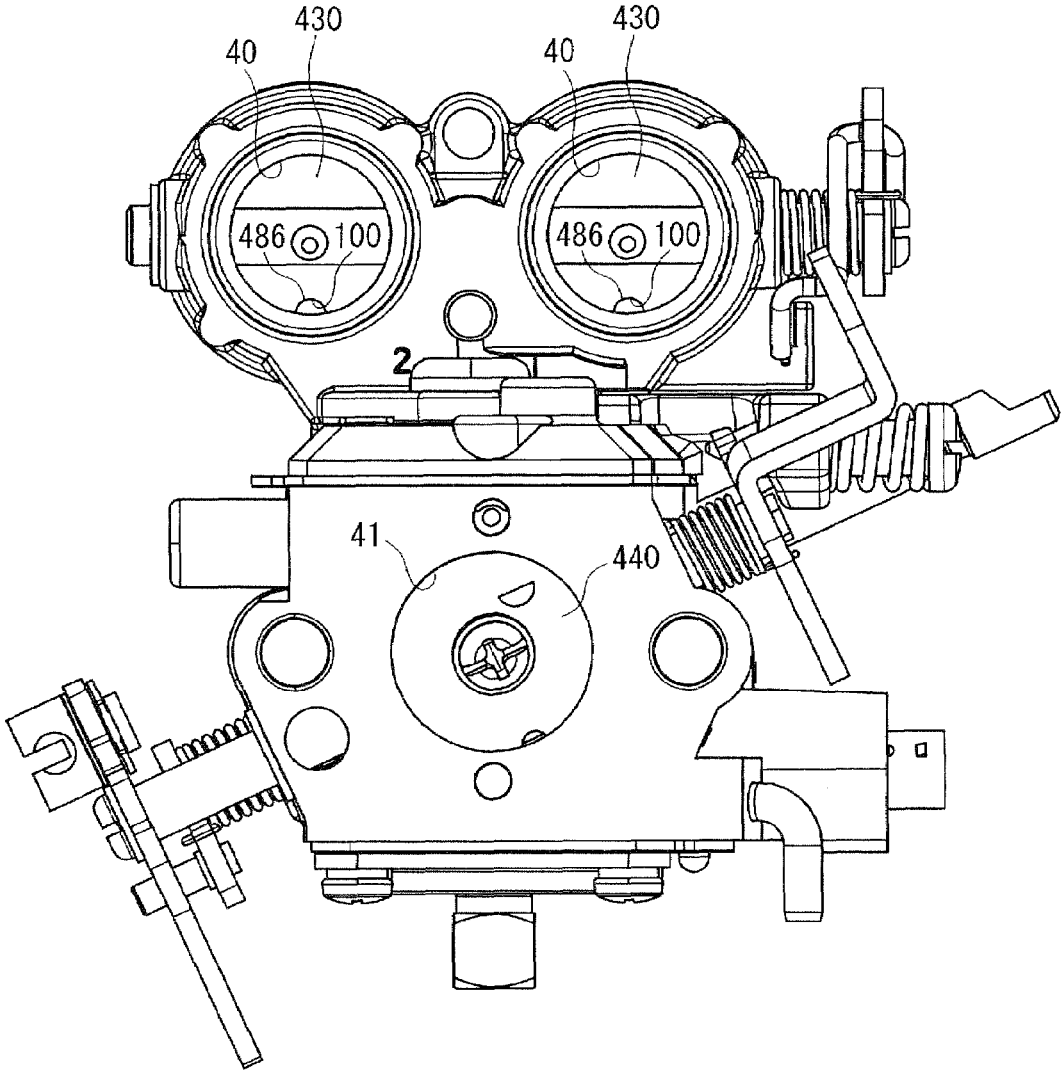
FIG. 19 illustrates the carburetor during idling as viewed from a side close to an insulator according to the eighth exemplary embodiment.
Figure 20A:
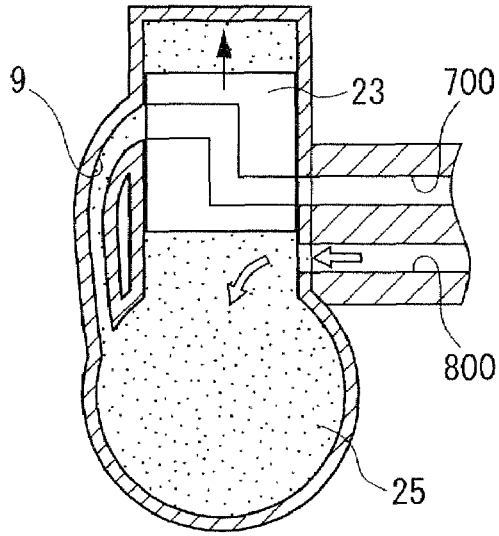
FIG. 20A PRIOR ART
FIG. 20A is a schematic diagram illustrating an intake process of a conventional stratified scavenging two-cycle engine during idling.
Figure 20B:
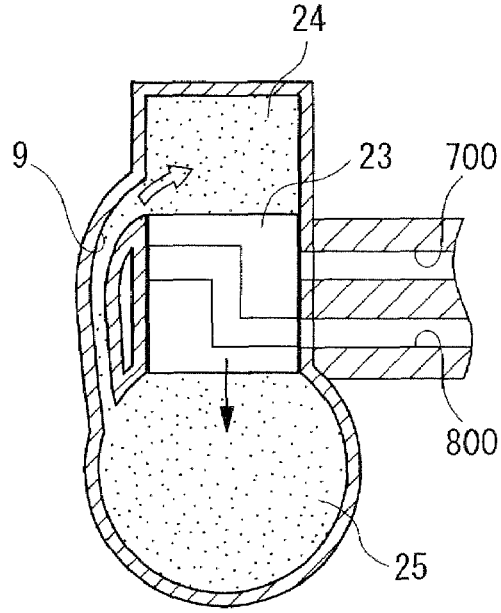
FIG. 20B PRIOR ART
FIG. 20B is a schematic diagram illustrating a scavenging process of the conventional stratified scavenging two-cycle engine during idling.
Figure 21A:
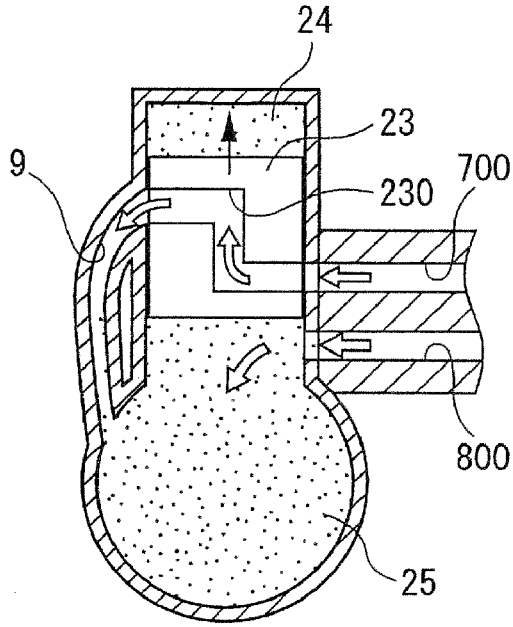
FIG. 21A PRIOR ART
FIG. 21A is a schematic diagram illustrating an intake process of the conventional stratified scavenging two-cycle engine in sudden acceleration from an idling state.
Figure 21B:
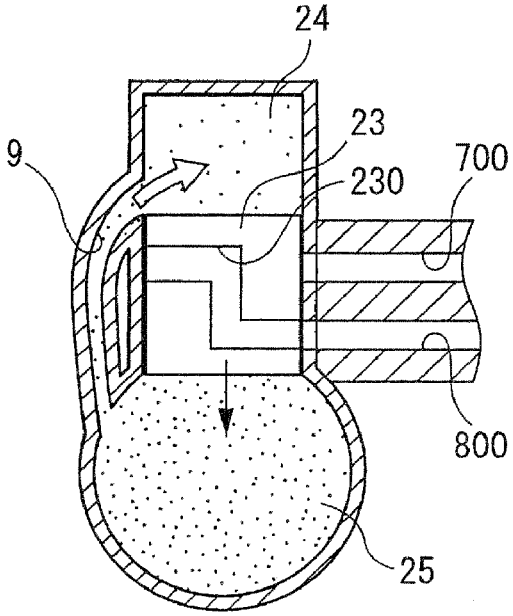
FIG. 21B PRIOR ART
FIG. 21B is a schematic diagram illustrating a scavenging process of the conventional stratified scavenging two-cycle engine in sudden acceleration from an idling state.

FIG. 18 is a cross sectional side view illustrating the carburetor 4 during idling and FIG. 19 illustrates the carburetor 4 during idling as viewed from a side close to the insulator 3 according to an eighth exemplary embodiment of the invention.

As shown in FIGS. 18 and 19, the air valves 430 and the mixture valve 440 are butterfly valves similarly to the sixth and seventh exemplary embodiments, and each of the air valves 430 includes each of semi-circular notches 486.

In the eighth exemplary embodiment, each of the auxiliary air passages 100 is defined by each of the notches 486, so that the same advantages as in the first exemplary embodiment can be attained.

The invention is not limited to the exemplary embodiments described above, but includes other arrangements as long as an object of the invention can be achieved, which includes the following modifications.

For example, the carburetor 4 including the butterfly air valves 430 as described in the sixth to eighth exemplary embodiments may be provided with a tubular passage in the thick portion of the carburetor 4 to intercommunicate between a side close to the air cleaner 5 of the carburetor air passage 40 and the other side close to the engine body 2 over the air valves 430 similarly to the third exemplary embodiment. With such an arrangement, the tubular passage defines the auxiliary air passage 100, so that the same advantages as in the first exemplary embodiment can be attained.

Although the piston valve method is employed as the intake method of the air-fuel mixture in the engine 1 of the first exemplary embodiment, a lead valve method for controlling the intake of the air-fuel mixture by a lead valve in the cylinder mixture passage 8 which is apertured in the crank chamber 25 or other valve methods may be employed.

The invention claimed is:

1. A stratified scavenging two-cycle engine comprising:

a cylinder defining a cylinder air passage and a scavenging passage;

an air cleaner for providing pure air;

an air passage system that delivers pure air from the air cleaner to the scavenging passage through an air passage;

a carburetor comprising an air valve that regulates the air passage and that is closable to thereby close the air passage; and an auxiliary air passage system that delivers pure air from the air cleaner to the scavenging passage through an auxiliary air passage while the air valve is completely closed or minimally open for idling;

wherein the auxiliary air passage system includes a pipe that is attached to connect the air cleaner and the cylinder to extend along an outside of the carburetor, and the pipe directly intercommunicates a downstream side of the air cleaner and the cylinder air passage.

2. A stratified scavenging two-cycle engine comprising:

a cylinder defining a cylinder air passage and a scavenging passage;

an air cleaner for providing pure air;

an air passage system that delivers pure air from the air cleaner to the scavenging passage through an air passage;

a carburetor comprising an air valve that regulates the air passage and that is closable to thereby close the air passage;

an insulator disposed between the carburetor and the cylinder, the insulator defining an insulator air passage that is in communication with the cylinder air passage; and an auxiliary air passage system that delivers pure air from the air cleaner to the scavenging passage through an auxiliary air passage while the air valve is completely closed or minimally open for idling;

wherein the auxiliary air passage system includes a pipe that is attached to connect the air cleaner and the insulator to extend along an outside of the carburetor, and the pipe directly intercommunicates a downstream side of the air cleaner and the insulator air passage.

* * * * *